US009057990B2

(12) United States Patent
Yamaguchi

(10) Patent No.: US 9,057,990 B2
(45) Date of Patent: Jun. 16, 2015

(54) IMAGE FORMING APPARATUS

(71) Applicant: Wataru Yamaguchi, Nisshin (JP)

(72) Inventor: Wataru Yamaguchi, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 84 days.

(21) Appl. No.: 13/835,637

(22) Filed: Mar. 15, 2013

(65) Prior Publication Data

US 2013/0315624 A1 Nov. 28, 2013

(30) Foreign Application Priority Data

May 25, 2012 (JP) ..... 2012-119849

(51) Int. Cl.

*G03G 15/08* (2006.01)
*G03G 15/16* (2006.01)
*G03G 21/16* (2006.01)

(52) U.S. Cl.

CPC ..... *G03G 15/16* (2013.01); *G03G 15/1685* (2013.01); *G03G 21/168* (2013.01)

(58) Field of Classification Search

CPC ..... G03G 15/0178; G03G 2215/0119; G03G 15/755; G03G 2215/00143; G03G 2221/1642; G03G 15/11; G03G 15/1615; G03G 15/1655; G03G 15/6552; G03G 2215/0016; G03G 2215/0158; G03G 2215/1623; G03G 15/16

See application file for complete search history.

(56) References Cited

U.S. PATENT DOCUMENTS

| | | | | |
|---|---|---|---|---|
| 2007/0231003 | A1* | 10/2007 | Shoji | 399/121 |
| 2009/0202275 | A1* | 8/2009 | Nishida et al. | 399/165 |
| 2011/0064467 | A1 | 3/2011 | Hayakawa | |

FOREIGN PATENT DOCUMENTS

| | | | |
|---|---|---|---|
| JP | 2005-321556 | A | 11/2005 |
| JP | 2007-316218 | A | 12/2007 |
| JP | 2010-175689 | A | 8/2010 |
| JP | 2011-064897 | A | 3/2011 |

* cited by examiner

*Primary Examiner* — Roy Y Yi
(74) *Attorney, Agent, or Firm* — Banner & Witcoff, Ltd.

(57) ABSTRACT

An image forming apparatus including an image forming unit; a belt unit with a first roller, a second roller, an endless belt, and a frame; a frame positioning member arranged in the belt unit to define a position of the frame in the axial direction with respect to a body; a first roller positioning member arranged in the belt unit to define a position of the first roller in the axial direction with respect to the frame; a guiding member arranged in a position corresponding to one of axial-end sides of the first roller along the axial direction in the endless belt; and an engageable member arranged on the one of axial-end sides of the first roller in the belt unit, is provided. The frame positioning member, the first roller positioning member, and the engageable member are arranged on the same axial-end side along the axial direction.

6 Claims, 10 Drawing Sheets

IMAGE FORMING APPARATUS

CROSS REFERENCE TO RELATED APPLICATION

This application claims priority from Japanese Patent Application No. 2012-119849, filed on May 25, 2012, the entire subject matter of which is incorporated herein by reference.

BACKGROUND

1. Technical Field

An aspect of the present invention relates to an image forming apparatus with a belt unit capable of forming an image on a sheet.

2. Related Art

An image forming unit may be equipped with a belt unit, which is detachably attached to the image forming apparatus.

Methods to form an image in the image forming apparatus with the belt unit may include, for example, a direct method and an intermediate-transferring method. In the direct method, the image may be formed directly on a sheet which is conveyed on an endless belt in the belt unit. In the intermediate-transferring method, the image may be formed on an endless belt in the belt unit and transferred onto a sheet being conveyed.

SUMMARY

In either method, when the endless belt is not in a relatively correct position with respect to an image forming unit installed in a main body of the image forming apparatus, the image may not be correctly formed in a correct position on the sheet.

The present invention is advantageous in that an image forming apparatus with a belt unit, which is capable of forming an image on a sheet correctly, is provided.

According to an aspect of the present invention, an image forming apparatus is provided. The image forming apparatus includes an image forming unit attached to a body of the image forming apparatus and configured to form an image on a sheet; a belt unit detachably attached to the body of the image forming apparatus, while the belt unit includes a first roller and a second roller arranged to extend axially in parallel with each other along an axial direction; an endless belt strained around the first roller and the second roller; and a frame configured to support the first roller and a second roller rotatably. The image forming apparatus further includes a frame positioning member arranged in the belt unit and configured to define a position of the frame in the axial direction with respect to the body of the image forming apparatus; a first roller positioning member arranged in the belt unit and configured to define a position of the first roller in the axial direction with respect to the frame; a guiding member arranged in a position corresponding to the one of axial-end sides of the first roller along the axial direction in the endless belt and configured to protrude from a belt strip of the endless belt; and an engageable member arranged on the one of axial-end sides of the first roller in the belt unit and configured to restrict the endless belt from being moved in the axial direction by being engaged with the guiding member. The frame positioning member, the first roller positioning member, and the engageable member are arranged on the same axial-end side along the axial direction.

BRIEF DESCRIPTION OF THE ACCOMPANYING DRAWINGS

Figures 3A, 3B:
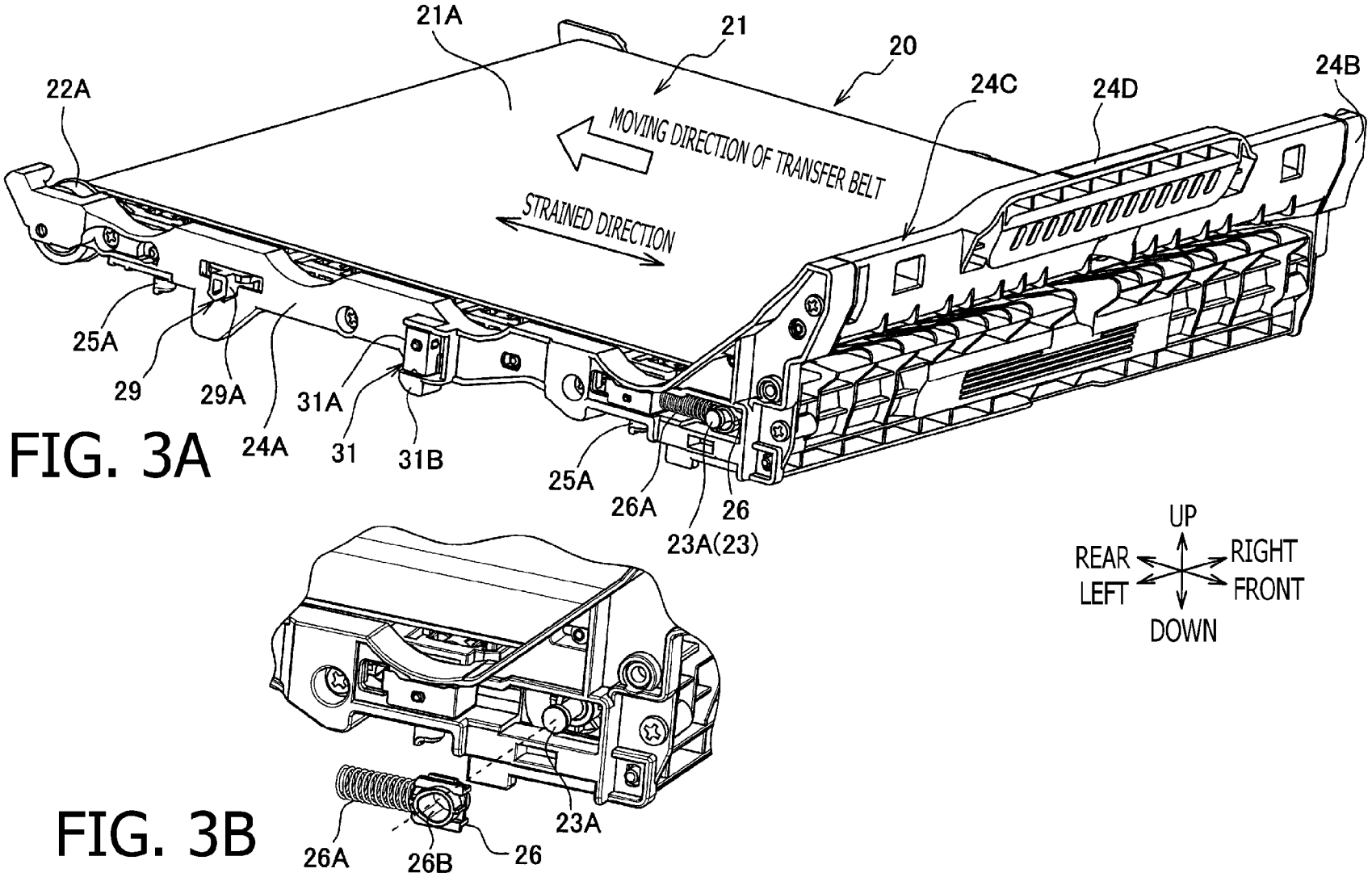

FIG. 3A is a perspective view of the belt unit 20 of the image forming apparatus 1 according to the embodiment of the present invention. FIG. 3B is an exploded view of a shaft support 26 for a driven roller 23 in the belt unit 20 according to the embodiment of the present invention.

Figure 4:
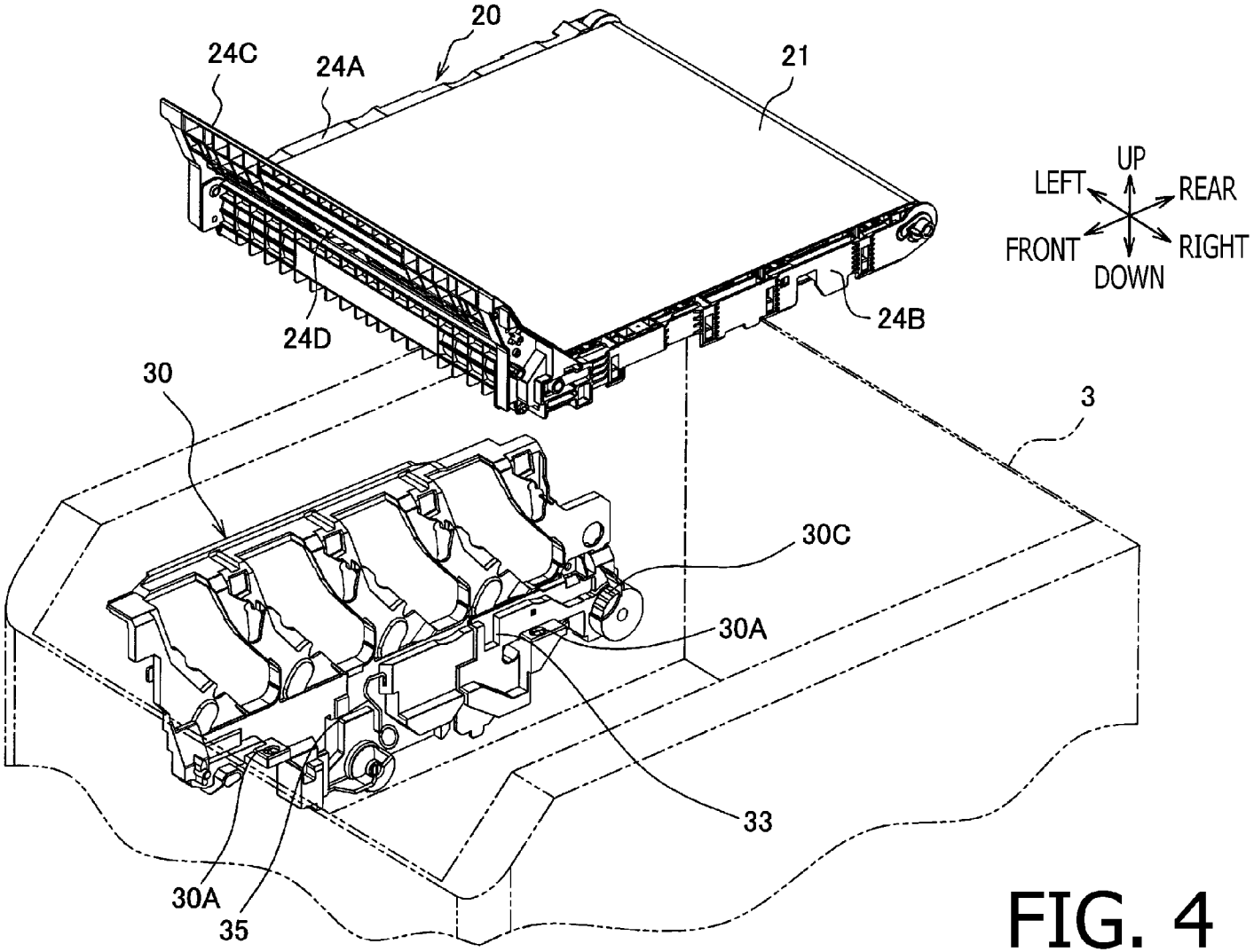

FIG. 4 illustrates the belt unit 20 and a main frame 30 to hold the belt unit 20 in the image forming apparatus 1 according to the embodiment of the present invention.

Figure 5:
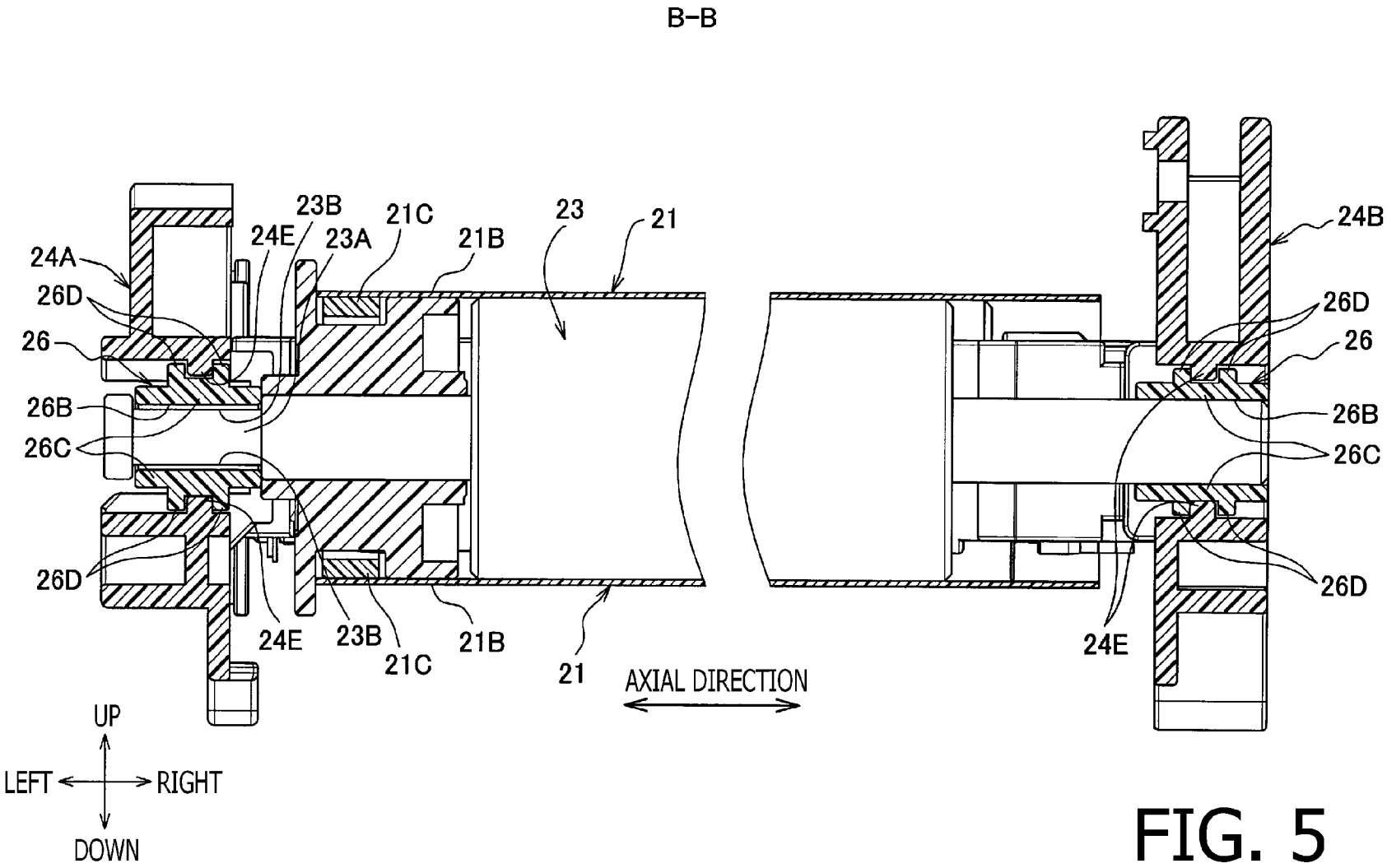
Figure 8:
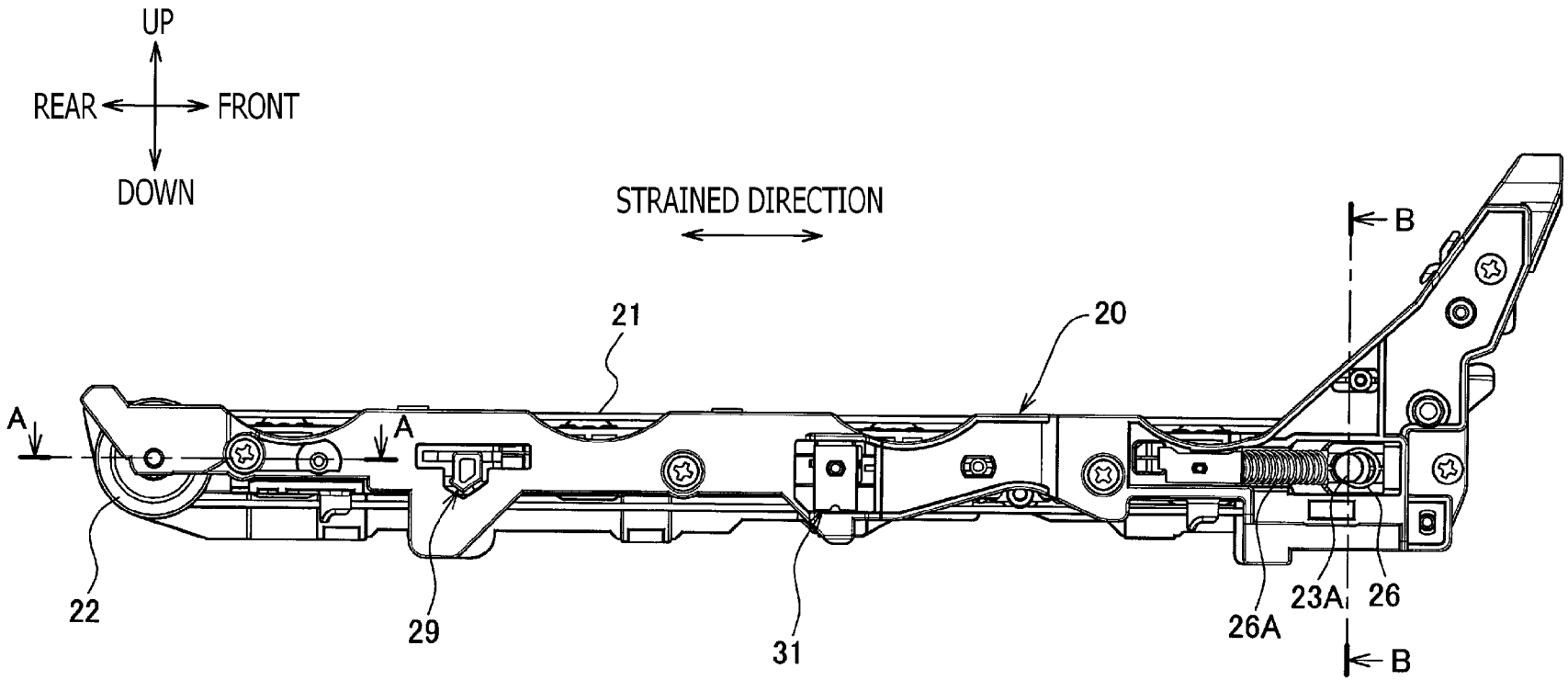

FIG. 5 is a cross-sectional view of the belt unit 20 according to the embodiment of the present invention taken along a line B-B shown in FIG. 8.

Figure 6:
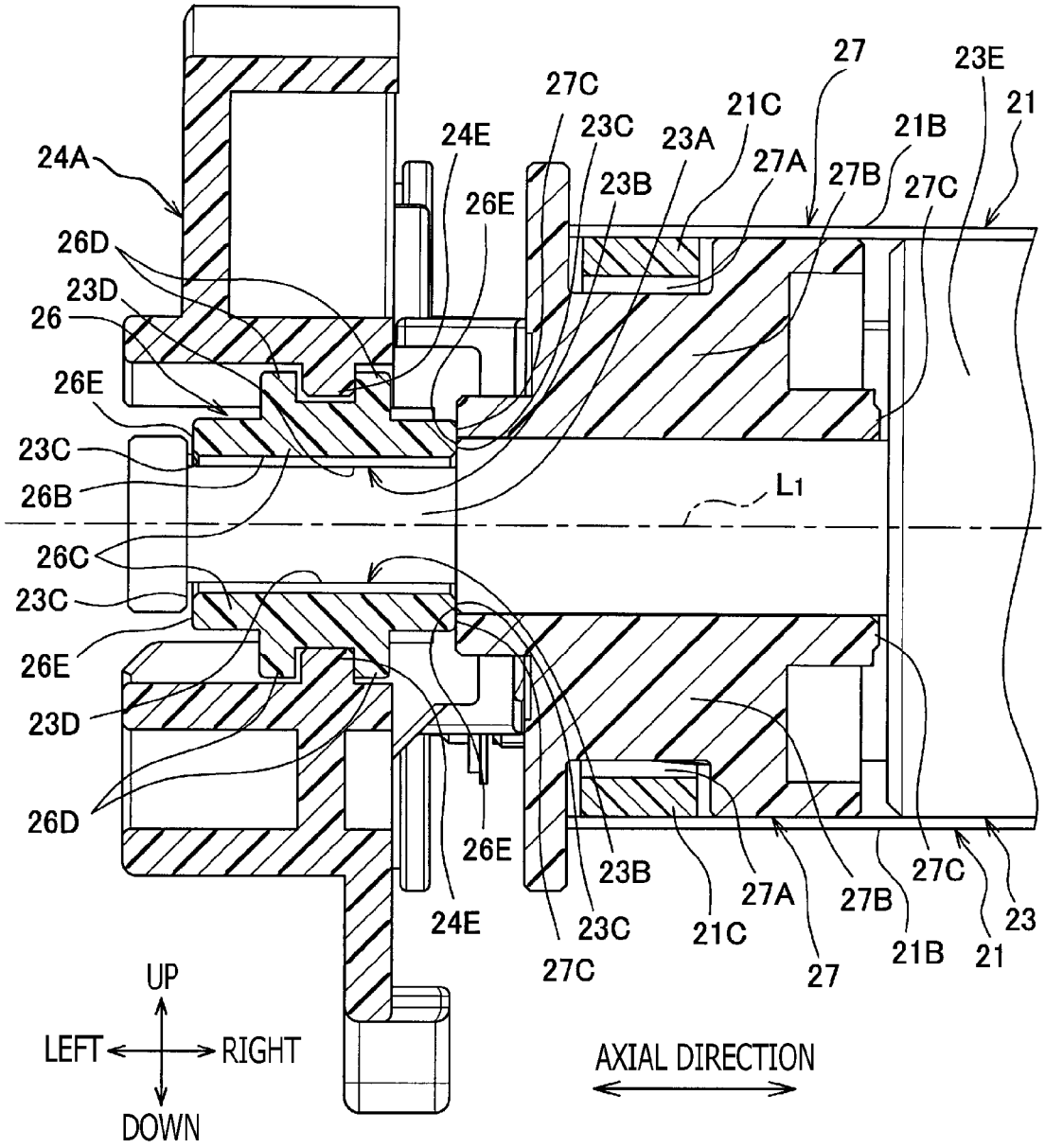

FIG. 6 is an enlarged cross-sectional view taken along the line B-B shown in FIG. 8 including a collar 27 on a lateral frame 24A in the belt unit 20 according to the embodiment of the present invention.

Figure 7:
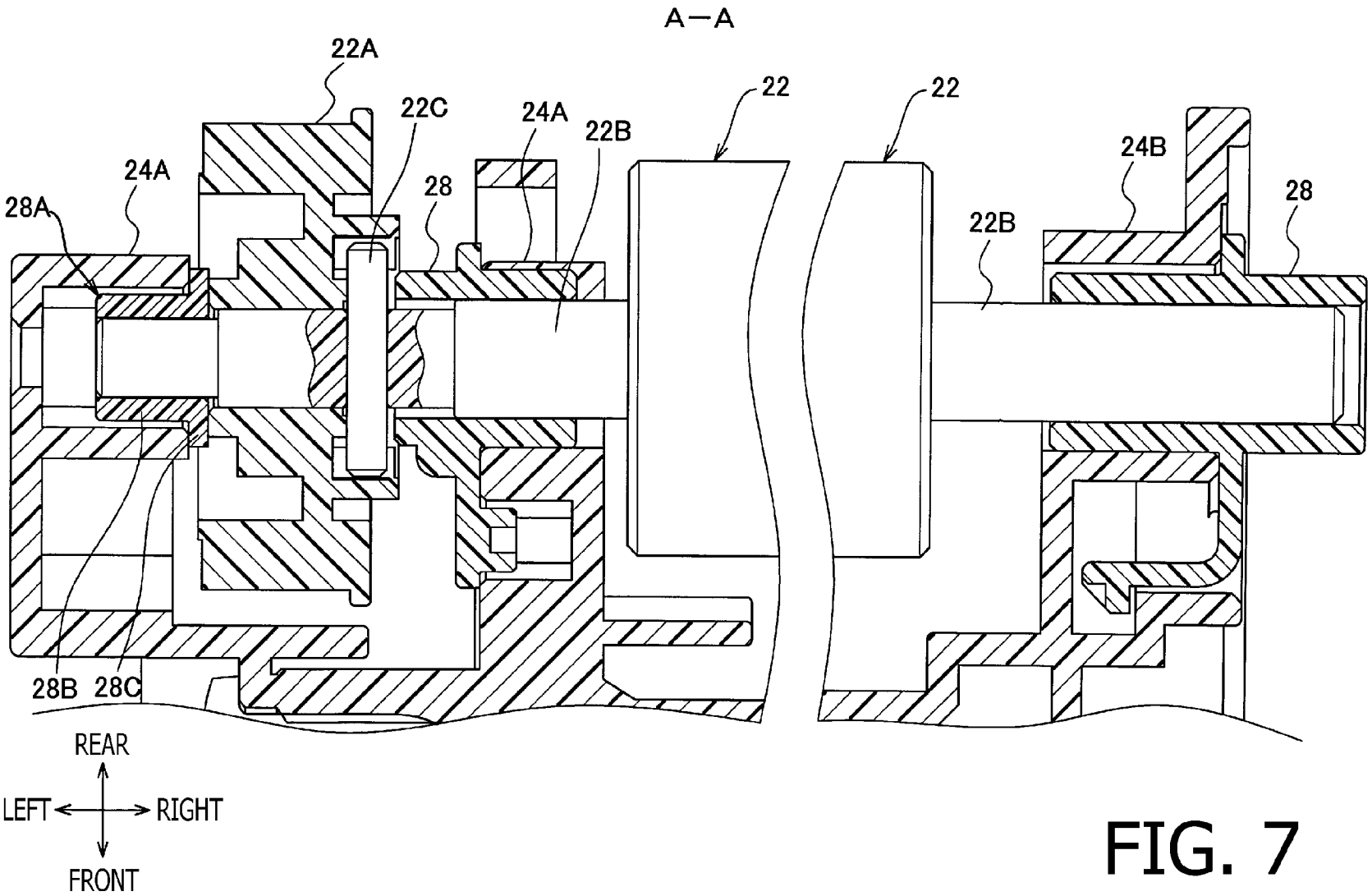

FIG. 7 is a cross-sectional view of the belt unit 20 according to the embodiment of the present invention taken along a line A-A shown in FIG. 8.

FIG. 8 is a side view of the belt unit 20 according to the embodiment of the present invention.

Figure 9:
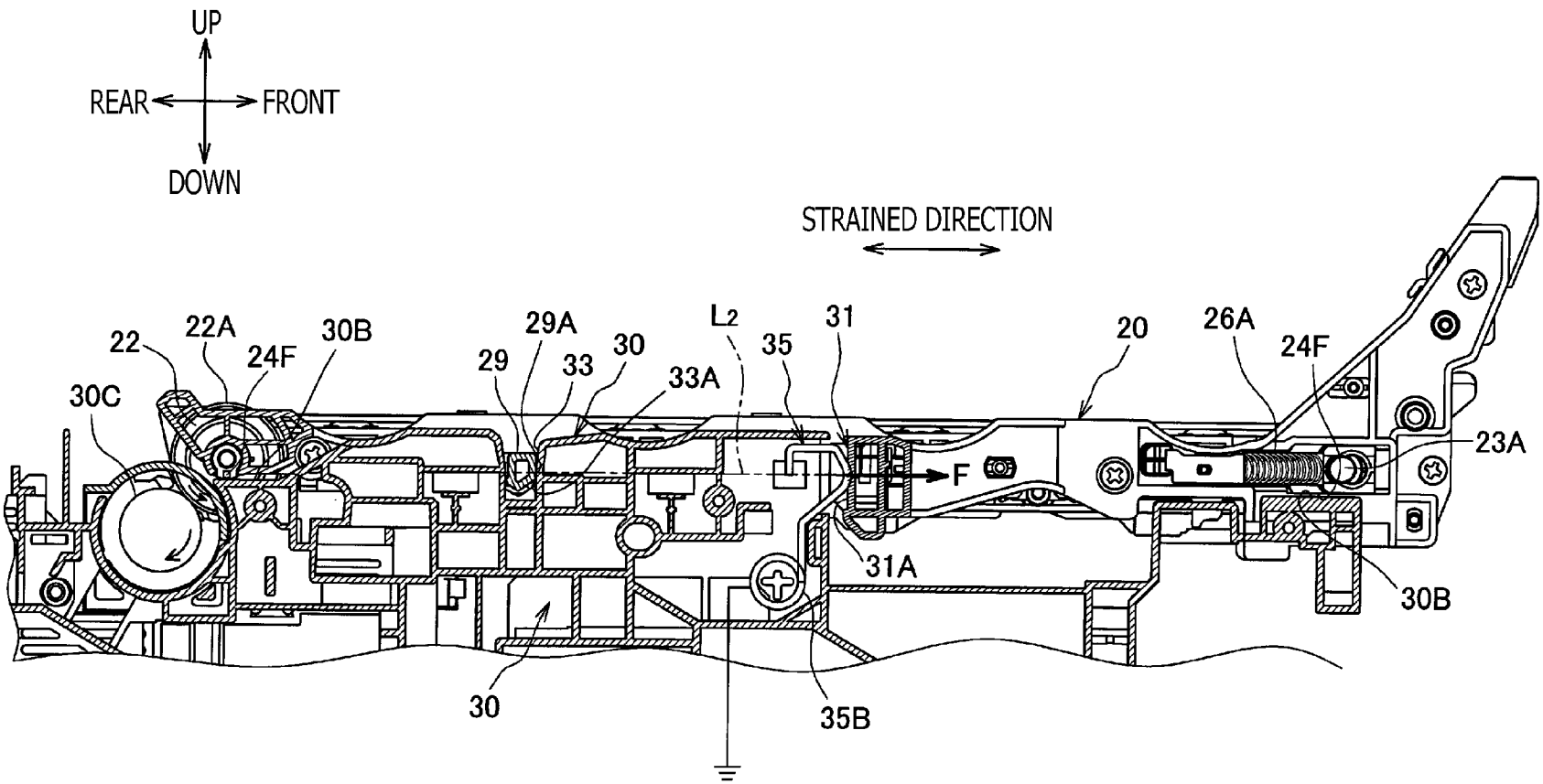

FIG. 9 is a side view of the belt unit 20 attached to the main frame 30 of the image forming apparatus 1 according to the embodiment of the present invention.

Figure 10:
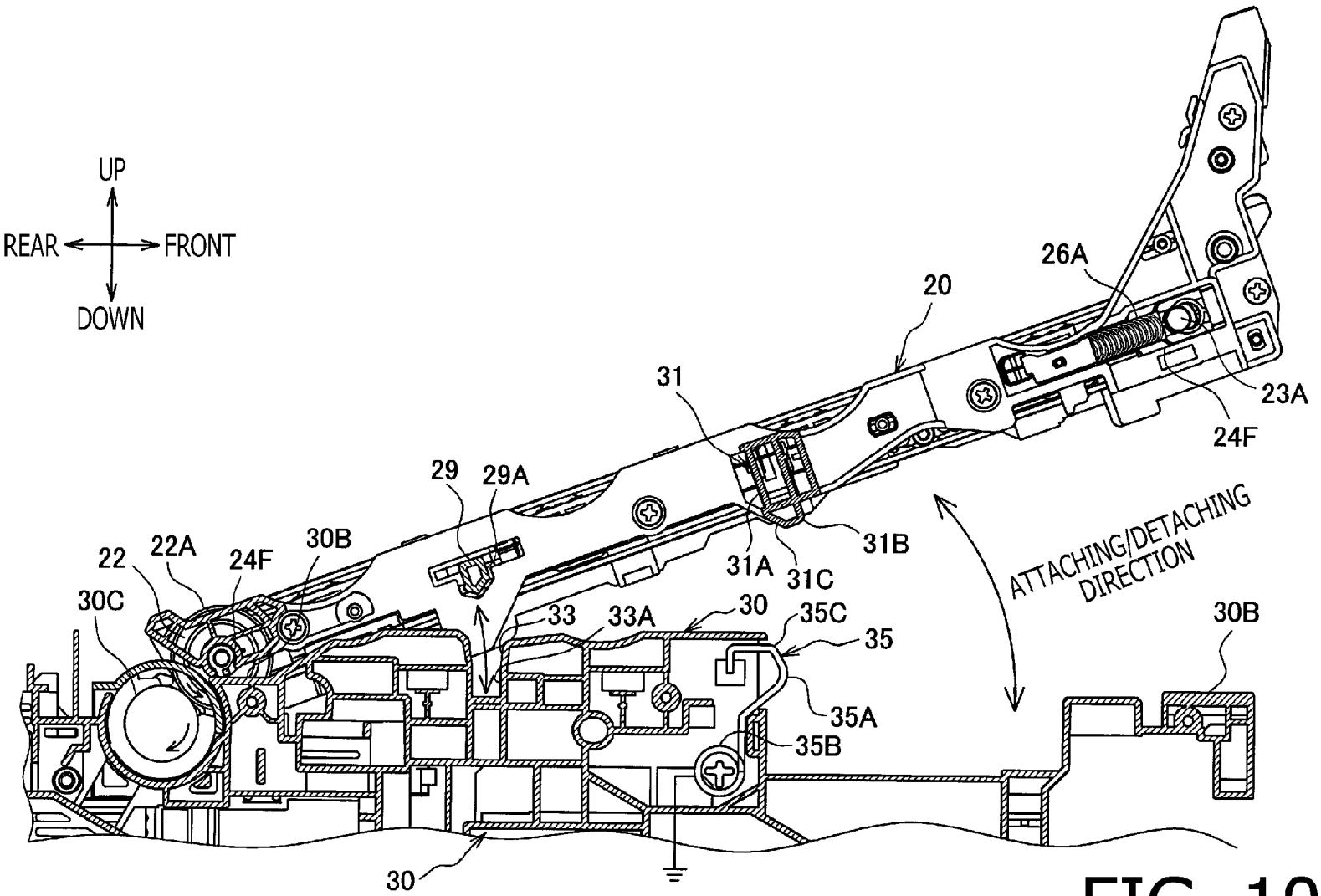

FIG. 10 illustrates the belt unit 20 in an attaching/detaching position in the main frame 30 of the image forming apparatus 1 according to the embodiment of the present invention.

DETAILED DESCRIPTION

Hereinafter, an embodiment of the present invention will be described with reference to the accompanying drawings. It is noted that various connections are set forth between elements in the following description. These connections in general, and unless specified otherwise, may be direct or indirect, and this specification is not intended to be limiting in this respect.

1. Overall Configuration of Image Forming Apparatus

Figure 1:
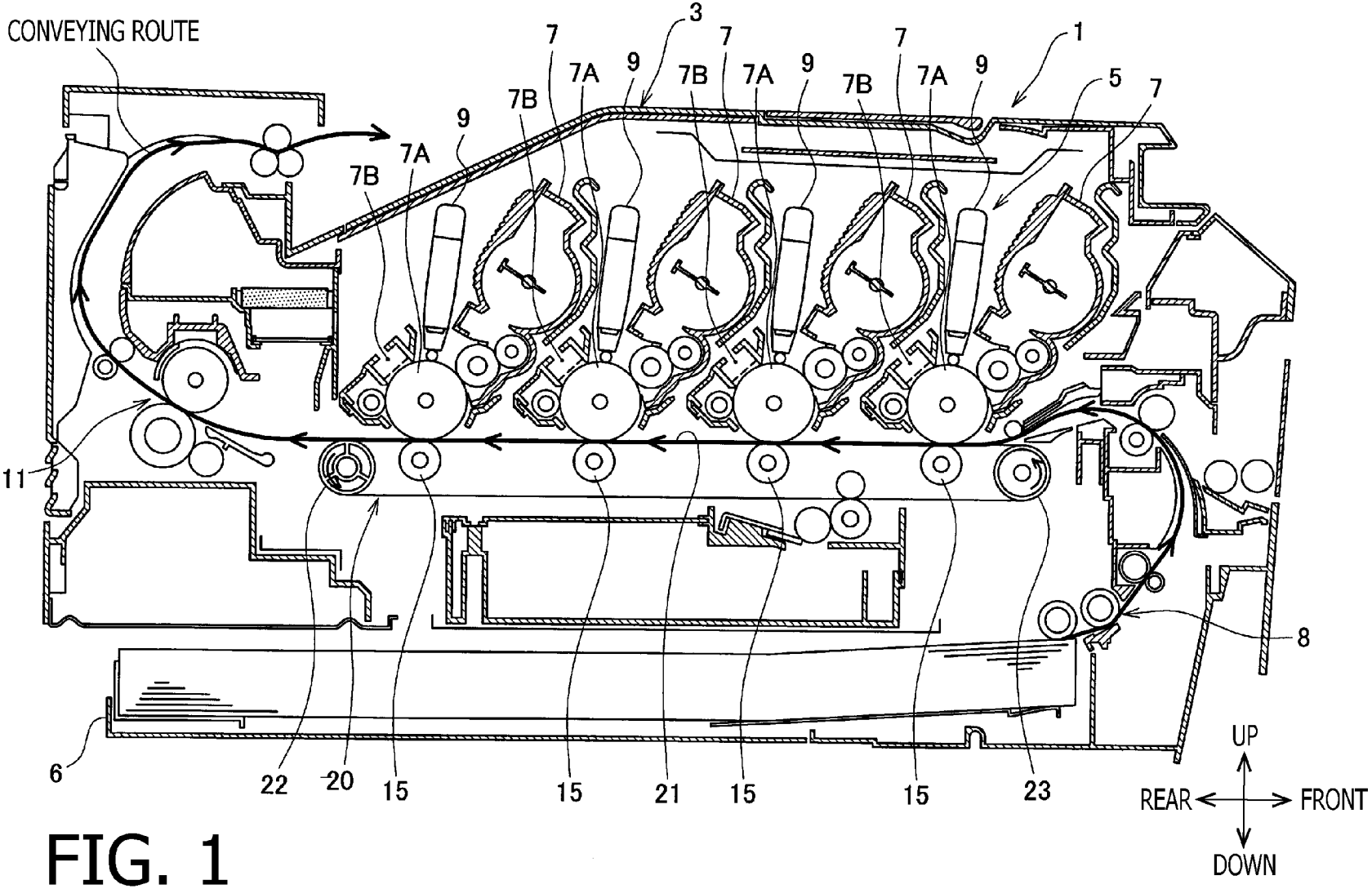
FIG. 1 is a cross-sectional side view of an image forming apparatus 1 according to an embodiment of the present invention.

An overall configuration of an image forming apparatus 1 according to the embodiment will be described with reference to FIG. 1. The image forming apparatus 1 being a multicolor electro-photographic image forming apparatus includes a chassis 3, which accommodates an image forming unit 5 inside. The image forming unit 5 is configured to transfer an image, which is formed in a developer agent, onto a sheet (unsigned) of recording paper in an electro-photographic method. The image forming unit 5 includes a processing unit 7, an exposure unit 9, and a fixing unit 11.

The image forming apparatus 5 is a direct tandem-typed image forming unit, in which a plurality of (e.g., four) processing units 7 align along a sheet conveying route.

Each of the processing units 7 contain a developer agent therein, and colors of the developer agents are different from one another. Other than the colors of the contained developer agents, the processing units 7 are configured identically to one another. Each processing unit 7 includes a photosensitive drum 7A, on which an image in the developer agent is formed, and a charger 7B to electrically charge the photosensitive drum 7A.

In a position opposite from the photosensitive drums 7A, across a transfer belt 21, transfer units 15, each of which includes a roller to transfer the developer agents carried on the photosensitive drums 7A to the sheet, are disposed. The developer agents carried on the photosensitive drums 7A are transferred to the sheet while the sheet is conveyed on the transfer belt 21.

To each transfer unit 15, electric voltage to transfer the developer agent from the photosensitive drum 7A to the sheet is applied. Therefore, in order to remove the electric voltage from the transfer unit 15 after transferring the developer agent, a brush or saw-teeth shaped neutralizer 21D (see FIG. 2) is arranged in the vicinity of each transfer unit 15. The transfer units 15, the neutralizers 21D, and the transfer belt 21 are arranged in the belt unit 20. Detailed configuration of the belt unit 20 will be described later.

A feeder tray 6 is disposed in a lower position with respect to the belt unit 20. The feeder tray 6 accommodates stacked sheets therein, and the sheets are picked up and conveyed one-by-one toward the image forming unit 5 by a feeder unit 8. The feeder tray 6 is removable from a main body of the image forming apparatus 1.

2. Belt Unit 2.1 Configuration of the Belt Unit

Figure 2:
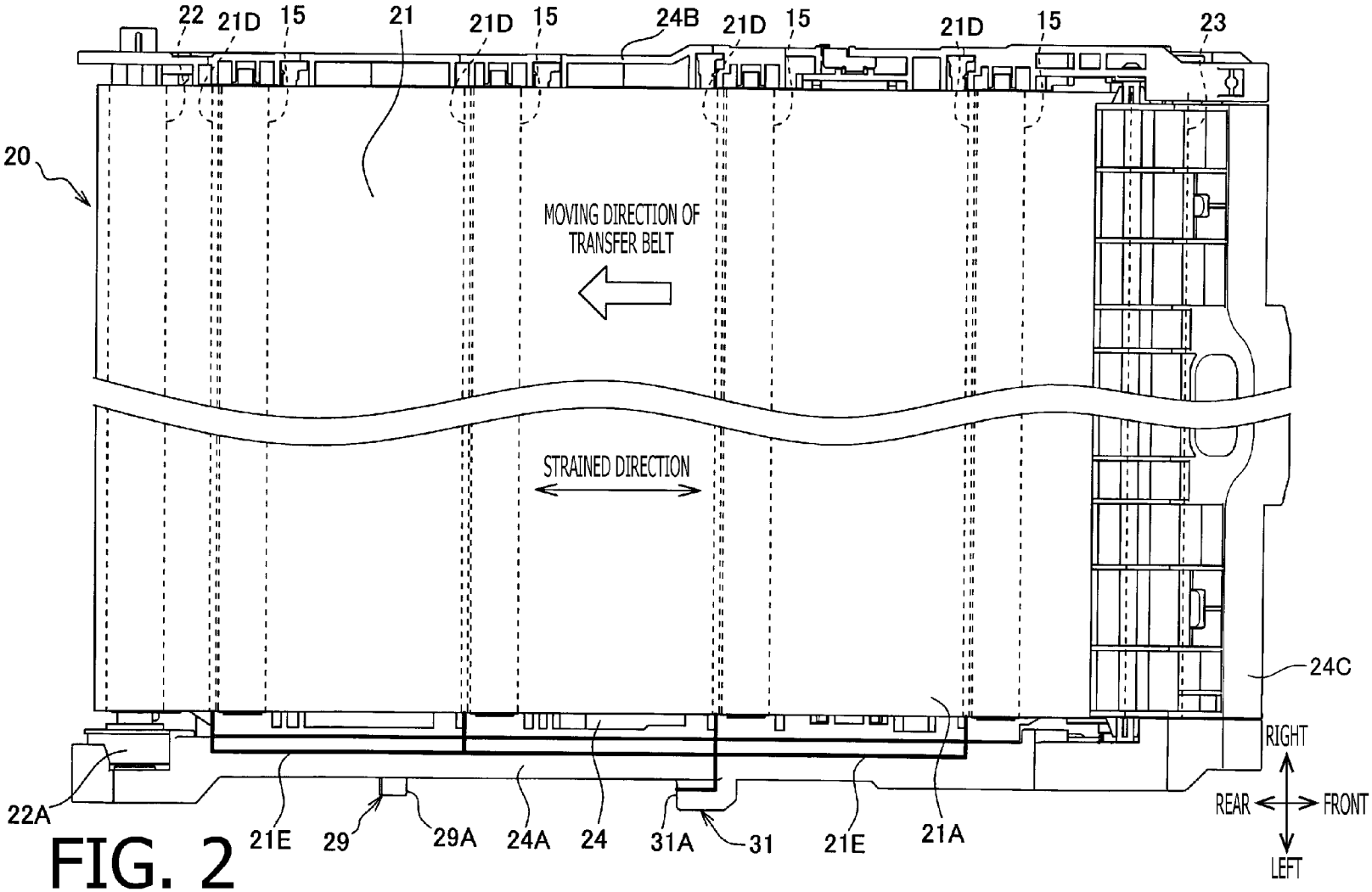
FIG. 2 is a top plan view of a belt unit 20 of the image forming apparatus 1 according to the embodiment of the present invention.

As shown in FIG. 2, the belt unit 20 includes the transfer belt 21, a driving roller 22, a driven roller 23, and a frame assembly 24 to hold the driving roller 22 and the driven roller 23.

The transfer belt 21 is an endless belt arranged in a strained condition to roll around the driving roller 22 and the driven roller 23 along with rotation of the driving roller 22 and the driven roller 23. The driving roller 22 is a roller to circulate the transfer belt 21, and the driven roller 23 is rotated by the driving roller 22 along with the circulation of the transfer belt 21. The endless belt denotes a belt which has no end along a rolling direction and can be circulated around the rollers endlessly.

The frame assembly 24 includes lateral frames 24A, 24B, which are arranged on axial (left and right) sides of the driving roller 22 along an axial direction to extend in parallel with a strained direction of the transfer belt 21. The strained direction denotes a direction of tensile force, which is produced in a strained surface 21A of the transfer belt 21 when the transfer belt 21 is installed in the frame assembly 24. The strained surface 21A denotes a surface of the transfer belt 21 which faces the photosensitive drums 7A when the belt unit 20 is installed in the image forming apparatus 1. In the present embodiment, the axial direction coincides with a widthwise (right-left) direction of the image forming apparatus 1 and includes a direction of an axis of the driving roller 22 and a direction of an axis of the driven roller 23. Meanwhile, an axial-end side along the axial direction denotes an area closer to an axial end of the driving roller 22 or the driven roller 23 with respect to a widthwise center of image forming apparatus 1 along the axial direction. In the following description, one of the axial-end sides denotes a left-hand side along the axial direction with respect to the widthwise center, and the other of the axial-end sides denotes a right-hand side along the axial direction with respect to the widthwise center.

As shown in FIG. 3, the lateral frames 24A, 24B are fixed in the frame assembly 24 by a fastening means such as screws (unsigned). On one of longitudinal ends of the lateral frame 24A closer to the driven roller 23 and on one of longitudinal ends of the lateral frame 24B closer to the driven roller 23, a gripper frame 24C extending along the axial direction to bridge between the lateral frames 24A, 24B are attached.

The gripper frame 24C includes a gripper 24D, by which the belt unit 20 is gripped, while the belt unit 20 is detachably attached to a main frame 30 (see FIG. 4) in the chassis 3 of the image forming apparatus 1. A user of the image forming apparatus 1 may grip onto the gripper 24D when the user attaches and removes the belt unit 20 to and from the image forming apparatus 1.

The main frame 30 of the image forming apparatus 1 includes a paired frames, which are arranged on both axial (right and left) sides of the chassis 3 along the axial direction. Therefore, the belt unit 20 is installed in the image forming apparatus 1 to bridge between the paired main frame 30 on the right and left sides along the axial direction. In the following description, unless otherwise noted, "the main frame 30" denotes one of the paired main frames 30 closer to the lateral frame 24A.

The lateral frame 24A is formed to have frame positioning members 25A (see FIG. 3). The frame positioning members 25A are engageable with one of in-body positioning members 30A (see FIG. 4), which are arranged in the main frame 30. Thus, with the frame positioning members 25A being engaged with the in-body positioning members 30A, the lateral frame 24A can be set in a correct position in the axial direction within the image forming apparatus 1 and with respect to the main frame 30.

The frame positioning members 25A include, as shown in FIG. 3A, a pair of cylindrical protrusions, which protrude downward. Meanwhile, the in-body positioning members 30A include, as shown in FIG. 4, a pair of openings, in which the frame positioning members 25A can be inserted.

Each of the in-body positioning member 30A is formed to have an oval shape, in which a direction of a minor axis thereof coincides with the axial direction, and a direction of major axis thereof coincides with the strained direction. A dimension of the minor axis of the oval is substantially equal to an outer diameter of the frame positioning member 25A.

Thus, by placing the frame positioning members 25A inserted in the in-body positioning members 30A, the belt unit 20 can be placed in the correct position in the axial direction. Meanwhile, the image forming apparatus 1 has a resilient member (not shown), which urges the belt unit 20 toward the lateral frame 24A, on the lateral frame 24B.

The driving roller 22 is rotatably held by the lateral frames 24A, 24B at axial ends thereof in a fixed position with respect to the lateral frames 24A, 24B. A roller gear 22A (see FIG. 2), which rotates along with the driving roller 22, is arranged on one of the axial-end sides of the driving roller 22 along the direction.

Meanwhile, on the main frame 30, a driving gear 30C (see FIG. 4) is arranged. The driving gear 30C is engaged with the roller gear 22A and supplies driving force to the driving roller 22. The driving gear 30C is rotated by rotating force supplied from an electric motor (not shown).

The driven roller 23 is rotatably held by the lateral frames 24A, 24B at axial ends thereof and is movable in the strained direction. In other words, as shown in FIG. 3B, shafts 24A of the driven roller 23 are rotatably held in shaft supports 26 at the axial ends thereof. The shaft supports 26 are attached to the lateral frames 24A, 24B and movable in the strained direction.

On each of the lateral frames 24A, 24B, a resilient member 26A such as a coil spring is arranged. The resilient member 26A provides resilient force, which is in a direction from the driving roller 22 toward the driven roller 23, and applies the resilient force to the shaft support 26. Thus, the driven roller 23 generates predetermined intension of tensile force in the strained surface 21A.

The shaft support 26 is formed to have a shaft hole 26B. The shaft hole 26B is an opening, of which inner circumference is formed to slidably contact an outer circumference of a shaft 23A of the driven roller 23. In particular, the shaft hole 26B is formed to have a cross-sectional shape of a smaller diameter circle and a larger diameter circle partly merged together, while a curvature radius of the smaller diameter circle is substantially equal to a curvature radius of the shaft 23A, and a curvature radius in the larger diameter circle is greater than the curvature radius of the shaft 23A. The smaller-diameter circular section is formed in a position closer to the driving roller 22, while the larger-diameter circular section is formed in a position farther from the driving roller 22 along the strained direction.

The shaft support 26 includes, as shown in FIG. 5, a tubular section 26C, in which a shaft hole 26B is formed, and a positioning section 26D, which is formed on an outer periphery of the tubular section 26C. The positioning section 26D is formed to have protrusions, and in between the protrusions along the axial direction, a rail 24E is interposed.

The rail 24E is formed in each of the lateral frames 24A, 24B. The rail 24E is a linearly formed protrusion extending along the strained direction, and the positioning section 26D having the paired protrusions is in slidably contact with lateral faces of the rail 24E. The lateral faces of the rail 24E refer to surfaces which are orthogonal to the axial direction. With the rail 24E slidably interposed in between the protrusions of the positioning section 26D, the shaft support 26 is placed in a correct position with respect to the lateral frames 24A, 24B.

The driven roller 23 is formed to be smaller in a diameter at a dent 23B, which dents inward along an entire outer periphery of the driven roller 23, as shown in FIG. 6. The dent 23B is formed in a shaft of the driven roller 23 on one of the axial-end sides with the lateral frame 24A (e.g., the left-hand side). The dent 23B is slidably in contact with an inner circumference of the tubular section 26C, i.e., the smaller-diameter circular section, in the shaft hole 26B.

The dent 23B is an inwardly-dented groove, which is formed to have a cross-sectional shape of a three-sided concave having lateral faces 23C at axial ends along the axial direction and a bottom surface 23D on a level closer to a central axis L1. While the inner circumference of the tubular section 26C, i.e., the smaller-diameter circular section, is in slidably contact with the bottom surface 23D, the shaft 23A is rotatably supported by the shaft support 26.

While an end 26E of the tubular section 26C along the axial direction is in slidably contact with the lateral face 23C of the dent 23B, the shaft 23A is placed in a correct position in the axial direction with respect to the shaft support 26. In other words, the dent 23B defines a correct position of the driven roller 23 in the axial direction with respect to the shaft support 26.

Further, the position of the shaft support 26 with respect to the lateral frame 24A along the axial direction is defined by the positioning section 26D. Thus, the dent 23B serves to place the driven roller 23 in the correct position in the axial direction with respect to the lateral frame 24A. In other words, the position of the driven roller 23 in the axial direction is defined with reference to the lateral frame 24A.

Meanwhile, the transfer belt 21 includes a guided part 21C, which protrudes inwardly from a belt strip 21B, in a position corresponding to one of axial-end sides (e.g., a left-hand side) of the belt strip 21B. More specifically, the guided part 21C is a linearly-formed protrusion extending in the strained direction at a widthwise end (e.g., a leftward) position along an inner circumferential surface of the belt strip 21B.

In the belt unit 20, on the other hand, an engageable part 27A is arranged on one of the axial-end sides (e.g., the left-hand side) of the driven roller 23 along the axial direction. With the guided part 21C of the transfer belt 21 engaged with in the engageable part 27A, the transfer belt 21 is restricted from moving in the axial direction.

The engageable part 27A is formed in a circular shape to circle about the central axis L1 of the shaft 23A. With the guided part 21C of the transfer belt 21 being set in the engageable part 27A, the transfer belt 21 is restricted from moving in the axial direction.

The engageable part 27A is formed in a collar 27, which is rotatable independently from the driven roller 23. The collar 27 is formed to have a tubular body 27B, in which a shaft hole is formed. In the shaft hole of the tubular body 27B, the shaft 23A is inserted, and the outer circumference of the shaft 23A is slidable with the shaft hole.

The engageable part 27A is formed on the outer circumference of the tubular body 27B of the collar 27. Further, a collar positioning member 27C to define a position of the collar 27 in the axial direction is formed at an axial end of the tubular body 27B along the axial direction.

In particular, the tubular body 27B of the collar 27 is interposed in between the shaft support 26 and a larger diameter section 23E of the driven roller 23 along the axial direction. In this regard, the collar 27 is placed in a correct position in the axial direction by having the collar positioning member 27C closer to the shaft support 26 to contact the tubular section 26C of the shaft support 26, and by having the collar positioning member 27C closer to the larger diameter section 23E of the driven roller 23 to contact the larger diameter section 23E.

Thus, the shaft support 26 is placed in a correct position with respect to the lateral frame 24A by the positioning section 26D of the shaft support 26. The driven roller 23 is placed in a correct position with respect to the lateral frame 24A indirectly by the dent 23B being placed in the correct position with respect to the shaft support 26. The collar 27, in particular, the engageable part 27A, is placed in a correct position with respect to the lateral frame 24A indirectly by the engageable part 27A being placed in the correct position with respect to the shaft support 26 and the driven roller 23.

It is noted, in the present embodiment, that the frame positioning member 25A, the dent 23B to define the position of the driven roller 23 in the axial direction, and the engageable part 27A, are arranged on the side of the lateral frame 24A along the axial direction.

Meanwhile, in the belt unit 20, bearings 28 to define the position of the driving roller 22 in the axial direction with respect to the lateral frame 24A are provided. In particular, as shown in FIG. 7, on each axial end of the driving roller 22, the bearing 28, which rotatably supports a shaft 22B of the driving roller 22, is arranged.

One of the bearings 28 on the one side (e.g., the left-hand side) along the axial direction closer to the roller gear 22A is attached to the lateral frame 24A. On the other hand, the other of the bearings 28 on the other side (e.g., the right-hand side) along the axial direction is attached to the lateral frame 24B. In the following description, unless otherwise noted, "the bearing 28" denotes one of the paired bearings 28 attached to the lateral frame 24A.

The shaft 22B of the driving roller 22 penetrates the roller gear 22A, and an open end of the shaft 22B is rotatably supported by a bearing 28A being attached to the lateral frame 24A. Therefore, the part of the shaft 22B, which penetrates the roller gear 22A, supports the roller gear 22A from both right and left sides along the axial direction by the bearing 28 and the bearing 28A.

The bearing 28A is formed in a shape of a hat, including a tube 28B and a flange 28C. An inner circumference of the tube 28B slidably contacts an outer circumference of the shaft 22B. The flange 28C is formed at an axial end of the tube 28B on a side closer to the roller gear 22A.

With the flange 28C being in contact with the lateral frame 24A, the bearing 28A is placed in a correct position in the axial direction with respect to the lateral frame 24A. Further, with the bearing 28A being in contact with the roller gear 22A, the roller gear 22A is placed in a correct position in the axial direction with respect to the bearing 28A. Thus, the roller gear 22A is placed in a correct position in the axial direction with respect to the lateral frame 24A via the bearing 28A.

A pin 22C penetrates the shaft 22B to be engaged with the roller gear 22A and conveys rotation force transmitted to the roller gear 22A to the shaft 22B. With the pin 22C being in contact with the roller gear 22A, the shaft 22B is placed in a correct position in the axial direction with respect to the roller gear 22A. Thus, the driving roller 22 is placed in a correct position in the axial direction with respect to the lateral frame 24A via the bearing 28A, the roller gear 22A, and the pin 22C.

While the driving roller 22 is in the correct position in the axial direction via the bearing 28A, the roller gear 22A, and the pin 22C, the driving roller 22 is restricted from being moved toward the one of the axial-end sides along the axial direction (e.g., leftward in FIG. 7). Further, while the driving roller 22 is in the correct position in the axial direction via the bearing 28 and the pin 22C being in contact with each other, the driving roller 22 is restricted from being moved toward the other of the axial-end sides along the axial direction (e.g., rightward in FIG. 7).

The lateral frame 24A has a first contiguous part 29 and a pressed part 31, as shown in FIG. 8. The first contiguous part 29 is a protrusion, which protrudes from the lateral frame 24A toward the main frame 30 (e.g., leftward), and is formed integrally with the lateral frame 24A in a resin.

Meanwhile, as shown in FIG. 9, the main frame 30 is formed to have a first contact section 33 being a dent, in which the protrusive first contiguous part 29 can be caught. When the first contiguous part 29 is caught in the first contact section 33, a first contacting edge 33A of the first contact section 33, which is an edge closer to the pressed part 31 (see FIG. 10), and a first contiguous edge 29A of the first contiguous part 29, which is an edge closer to the pressed part 31, become in contact with each other along the strained direction (see FIG. 9).

The pressed part 31 is a protrusion, which protrudes from the lateral frame 24A toward the main frame 30 (e.g., leftward in FIG. 3), as shown in FIG. 3. The pressed part 31 is arranged in a position to be closer to the driven roller 23 with respect to the first contiguous part 29 (e.g., displaced frontward from the first contiguous part 29 in FIG. 3) along the strained direction.

The pressed part 31 includes a protrusion 31B, which is integrally formed with the lateral frame 24A, and a metal-made pressed edge 31A, which covers at least an edge of the protrusion 31B closer to the first contiguous part 29. The pressed edge 31A is connected with each of the neutralizers 21D via electrical wires 21E (see FIG. 2).

Meanwhile, the main frame 30 has a pressing member 35 (see FIG. 9). The pressing member 35 contacts the pressed edge 31A to press the pressed part 31 toward the driven roller 23 when the belt unit 20 is attached to the main frame 30, and when the first contiguous part 29 is caught in the first contact section 33. The pressing member 35 is a metal-made spring, which is resiliently deformable.

When the belt unit 20 is attached to the main frame 30, and pressure F from the pressing member 35 is applied to the pressed part 31, the first contiguous part 29 is pressed by the first contacting section 33 to increase contacting surface pressure between the first contacting edge 33A and the first contiguous edge 29A. Thus, the belt unit 20 is placed in a correct position with respect to the main frame 30 in the strained direction.

In this regard, the first contacting section 33, the first contiguous part 29, the pressing member 35, and the pressed part 31 are arranged in positions to have a line L2 (see FIG. 9), which connects the contacting position between the first contacting section 33 and the first contiguous part 29 and the contacting position between the pressing member 35 and the pressed part 31, to extend in parallel with the strained direction. A direction of the line L2 connecting the two contacting positions will be hereinafter referred to as a positioning direction L2.

Further, the contacting position between the first contacting section 33 and the first contiguous part 29 refers to either an area, in which the contacting surface pressure is the greatest, or a central area, in range in which the first contacting section 33 and the first contiguous part 29 contact each other. Similarly, the contacting position between the pressing member 35 and the pressed part 31 refers to either an area, in which the contacting surface pressure is the greatest, or a central area, within a range in which the pressing member 35 and the pressed part 31 contact each other.

The pressing member 35 is electrically connected to the ground. Therefore, when the belt unit 20 is attached to the main frame 30, and the pressed edge 31A and the pressing member 35 contact each other, the neutralizers 21D are grounded through the pressing member 35 and the pressed part 31.

Each of the lateral frames 24A, 24B has a second contiguous section 24F on each longitudinal end thereof along the longitudinal direction. Meanwhile, the main frame 30 has second contacting sections 30B, which contact the second contiguous sections 24F when the belt unit 20 is attached to the main frame 30.

With the second contacting sections 30B being in contact with the second contiguous sections 24F, the belt unit 20 is placed in a correct position with respect to the main frame 30 in a direction orthogonal to the strained surface 21A.

The direction orthogonal to the strained surface 21A, according to the present embodiment, is a normal direction and coincides with a vertical direction. On the other hand, the strained direction coincides with a horizontal direction. Therefore, when the second contacting sections contact the second contiguous sections 24F, the belt unit 20 is placed in a vertically correct position with respect to the main frame 30.

2.2 Attachment and Detachment of the Belt Unit

As shown in FIG. 10, the pressing member 35 includes a torsion coil spring, and a coiled end 35B of the coil spring is fixed to the main frame 30. With the coiled end 35B fixed to the main frame 30, the pressing member 35 is resiliently deformable, and the other end of the pressing member 35 being opposite from the coiled end 35 is swingable about the coiled end 35B.

The pressing member 35 is formed to further have a contact part 35A, which is formed in a triangular shape protruding toward the driven roller 23, in a position between the coiled end 35B and the other end. The contact part 35A is contiguous with the pressed part 31 of the lateral frame 24A. Furthermore, the pressing member 35 is formed to have a guiding edge 35C in a range closer to the belt unit 20 with respect to the contact part 35. The guiding edge 35C is formed to incline from a peak of the triangular shape of the contact part 35A toward the driving roller 22 along an attaching/detaching direction (see FIG. 10) of the belt unit 20, as the pressing member 35 ascends to be closer to the belt unit 20.

On the other hand, the pressed part 31 of the lateral frame 24A is formed to have a guiding edge 31C in a position closer to the pressing member 35 with respect to the pressed edge 31A and between the pressed edge 31A and the protrusion 31B. The guiding edge 31C is formed to incline from the pressed edge 31A toward the driven roller 23 along the attaching/detaching direction of the belt unit 20.

When the belt unit 20 is attached to the main frame 30, as shown in FIG. 10, while the second contiguous section 24F closer to the driving roller 22 is placed to be in contact with the second contacting section 30B, a front side of the belt unit 20, which is a side closer to the driven roller 23, is moved toward the main frame 30, i.e., downward.

When the pressing member 35 and the pressed part 31 come into contact, the guiding edge 35C of the pressing member 35 and the guiding edge 31C of the pressed part 31 slidably contacts each other, and the pressing member 35 is resiliently deformed toward the driving roller 22. Further, as shown in FIG. 9, the first contiguous part 29 of the lateral frame 24A is inserted in the first contacting section 33 of the main frame 30.

When the first contiguous part 29 and the first contacting section 33 contact each other (see FIG. 9), the pressing member 35 is resiliently deformed toward the driving roller 22 compared to the posture of the pressing member 35 when the first contiguous part 29 and the first contacting section 33 do not contact each other (see FIG. 10). Thus, the pressure F is applied from the pressing member 35 to the pressed part 31.

On the other hand, when the belt unit 20 is detached from the main frame 30, the belt unit 20 is rotated about the second contiguous section 24F, which is on a side closer to the driving roller 22, upwardly to separate the front side with the driven roller 23 apart from the main frame 30 (see FIG. 10).

3. Features of the Image Forming Apparatus with the Belt Unit

As has been described above, the frame positioning member 25A, the dent 23B, and the engageable part 27A, are arranged on the same axial-end side, i.e., the left-hand side with the lateral frame 24A, along the axial direction. Therefore, the driven roller 23 is positioned with reference to the same axial-end side along the axial direction as the belt unit 20. Further, the transfer belt 21 is restricted from being moved in the axial direction on basis of the same axial-end side as the driven roller 23.

Accordingly, the relative position of the transfer belt 21 with respect to the image forming unit 5 falls within a range of tolerances accumulated based on the position of the lateral frame 24A. Generally, when tolerances accumulated based on different positions and tolerances accumulated on one position are compared, even if the parts and components belong to a same level of tolerance class, while a basic dimension for the tolerances accumulated on the one position is smaller than basic dimensions for the tolerances accumulated on different positions, the tolerances accumulated on the one position is summed to be smaller than the tolerances accumulated on the different positions.

In this regard, the tolerance class denotes a group of tolerances which belong to a same accuracy level with respect to a basic dimension. When the accuracy level for each component is toughened, a quantity of manufacturing process increases, and manufacturing costs tend to be increased.

Meanwhile, according to the present embodiment, without relaxing the accuracy level of the tolerance class for each component largely, the relative position of the transfer belt 21 with respect to the image forming unit 5 can be maintained within the tolerated range. Thus, the image may be formed in a correct position on the sheet.

More Examples

Although an example of carrying out the invention has been described, those skilled in the art will appreciate that there are numerous variations and permutations of the belt unit and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the dent 23 in the shaft 23A to define the position of the driven roller 23 in the axial direction may not necessarily be the concave, but the position of the driven roller 23 in the axial direction may be defined by a protrusion formed on the outer circumference of the shaft 23A.

For another example, the guided part 21C may not necessarily be a seamless strip of protrusion, which is continuously arranged on the inner peripheral surface of the belt strip 21B. For example, a toothed belt, on which smaller protrusions are intermittently arranged, may be employed.

For another example, the collar 27 may not necessarily be rotatable independently from the driven roller 23 but may be rotatable integrally along with the driven roller 23. Alternatively, the driven roller 23 may be formed to have the engageable part 27A.

For another example, the frame positioning member 25A, the dent 23B, and the engageable part 27A, may not necessarily be arranged on solely one of the axial-end sides along the axial direction but may be arranged on the both axial-end sides along the axial direction.

Further, the frame positioning member 25A, the dent 23B, and the engageable part 27A, may not necessarily be in the shapes as described above or illustrated in the accompanying drawings.

For another example, one or more additional rollers may be provided in addition to the driving roller 22 and the driven roller 23.

For another example, the present invention may not necessarily be applied to the direct-typed image forming apparatus but may be similarly applied to an intermediate transfer-typed image forming apparatus.

For another example, the exposure unit 9 provided to each of the photosensitive drums 7A may not necessarily be equipped with the plurality of LEDs aligned along the axial direction of the photosensitive drum 7A. The exposure unit 9 may be a so-called scanner-typed exposure unit, in which a laser beam scans the circumference of the photosensitive drum 7A along the axial direction.

What is claimed is:

1. An image forming apparatus, comprising:

an image forming unit attached to a body of the image forming apparatus and configured to form an image on a sheet;

a belt unit detachably attached to the body of the image forming apparatus, the belt unit comprising:

a first roller and a second roller arranged to extend axially in parallel with each other along an axial direction;

an endless belt extending around the first roller and the second roller; and a frame configured to rotatably support the first roller and the second roller;

a frame positioning member arranged in the belt unit and configured to define a position of the frame in the axial direction with respect to the body of the image forming apparatus;

a first roller positioning member arranged in the belt unit and configured to define a position of the first roller in the axial direction with respect to the frame;

a guiding member arranged in a position corresponding to an axial-end side of the first roller along the axial direction in the endless belt and configured to protrude from a belt strip of the endless belt; and an engageable member arranged on the axial end side of the first roller in the belt unit and configured to restrict the endless belt from being moved in the axial direction by engaging with the guiding member, wherein the frame positioning member, the first roller positioning member, and the engageable member are arranged on the same axial-end side along the axial direction, and wherein the first roller positioning member includes a concave groove formed on the axial-end side of the first roller.

2. The image forming apparatus according to claim 1, wherein the frame positioning member, the first roller positioning member, and the engageable member are arranged solely on the same axial-end side along the axial direction.

3. The image forming apparatus according to claim 1, wherein the engageable member is arranged in a collar, the collar being rotatable independently from the first roller, and wherein the collar comprises a collar positioning member, the collar positioning member configured to define a position of the collar in the axial direction with respect to the frame.

4. The image forming apparatus according to claim 1, further comprising:

a bearing configured to support the first roller rotatably; and a bearing positioning member configured to define a position of the bearing in the axial direction with respect to the frame, wherein the first roller positioning member is configured to define the position of the first roller in the axial direction with respect to the frame by defining a position of the first roller in the axial direction with respect to the bearing.

5. The image forming apparatus according to claim 1, further comprising:

a second roller positioning member configured to define a position of the second roller in the axial direction with respect to the frame, wherein the second roller positioning member is arranged on the same axial-end side along the axial direction as the first roller positioning member.

6. The image forming apparatus according to claim 1, wherein the second roller is a driving roller configured to circulate the endless belt, and wherein the first roller is a driven roller configured to be rotated along with circulation of the endless belt.

* * * * *